US007360491B2

(12) United States Patent
Sanborn

(10) Patent No.: US 7,360,491 B2
(45) Date of Patent: Apr. 22, 2008

(54) FIREARM PROJECTILE APPARATUS, METHOD, AND PRODUCT BY PROCESS

(76) Inventor: Craig M. Sanborn, R.R. 1 Box 405, Maidstone, VT (US) 05905

( * ) Notice: Subject to any disclaimer, the term of this patent is extended or adjusted under 35 U.S.C. 154(b) by 316 days.

(21) Appl. No.: 10/709,081

(22) Filed: Apr. 12, 2004

(65) Prior Publication Data

US 2005/0034626 A1 Feb. 17, 2005

(51) Int. Cl.
*F42B 12/34* (2006.01)
*F42B 10/00* (2006.01)
*F42B 14/00* (2006.01)

(52) U.S. Cl. ..... 102/510; 102/517; 102/503

(58) Field of Classification Search ..... 102/510, 102/509, 508, 507, 517, 518, 503
See application file for complete search history.

(56) References Cited

U.S. PATENT DOCUMENTS

| | | | | |
|---|---|---|---|---|
| 0,034,950 | A | 4/1862 | James | 102/520 |
| 0,035,273 | A | 5/1862 | Williams | 102/532 |
| 0,043,017 | A | 6/1864 | Ganster | 102/520 |
| 854,923 | A * | 5/1907 | Broad | 102/508 |
| 1,134,797 | A * | 4/1915 | Wood | 102/508 |
| 4,655,140 | A * | 4/1987 | Schirneker | 102/508 |
| 4,665,827 | A * | 5/1987 | Ellis, II | 102/510 |
| 4,938,147 | A * | 7/1990 | Czetto, Jr. | 102/507 |
| 5,160,805 | A * | 11/1992 | Winter | 102/518 |
| 5,185,495 | A * | 2/1993 | Petrovich et al. | 102/510 |
| 5,458,064 | A | 10/1995 | Kearns | 102/520 |
| 5,621,187 | A | 4/1997 | Kearns | 102/520 |
| 6,349,651 | B1 * | 2/2002 | Martinez Garcia | 102/517 |
| 6,845,717 | B1 * | 1/2005 | Sauvestre | 102/518 |
| 6,971,315 | B2 * | 12/2005 | Knappworst et al. | 102/510 |
| 2002/0139275 | A1 * | 10/2002 | Jensen | 102/510 |

* cited by examiner

*Primary Examiner*—James S Bergin
(74) *Attorney, Agent, or Firm*—Jay R. Yablon

(57) ABSTRACT

A firearm projectile assembly apparatus disclosed herein comprises: a bullet; a hollow core running completely through the bullet from a front of the bullet subassembly to a rear of the bullet; a core material within at least part of the hollow core; and an expansion-inducing tip integral with the core material, and protruding forward of the front of the bullet; wherein: when the projectile assembly impacts with a target, the expansion-inducing tip drives the core material rearward relative to the hollow core, forcing the bullet to expand radially outwardly. Also disclosed for firearm projectile assembly apparatus is a pressure shield; and a non-discarding attachment of the pressure shield to the bullet, such that after the projectile assembly is fired from a firearm, the pressure shield does not discard from the bullet during the bullet's flight to a target. Also disclosed is a pressure shield comprising: a gas check; and various controlled air spaces. Also disclosed are related methods of use and production for the firearm projectile assembly apparatus, and various subassemblies thereof.

56 Claims, 6 Drawing Sheets

| Caliber | Bullet (141) | Shield Max. (145) | Shield Rear (147) | Bullet Engraving (140) |
|---|---|---|---|---|
| .45 | ≅ .452-.454 | ≅ .458-.460 | ≅ .440 | ≅ .456-.457 |
| .50 | ≅ .502-.504 | ≅ .508-.510 | ≅ .490 | ≅ .506-.507 |
| .52 | ≅ .522-.524 | ≅ .528-.530 | ≅ .510 | ≅ .526-.527 |
| .54 | ≅ .542-.544 | ≅ .548-.550 | ≅ .530 | ≅ .546-.547 |
| .58 | ≅ .582-.584 | ≅ .588-.590 | ≅ .570 | ≅ .586-.587 |
FIG. 11
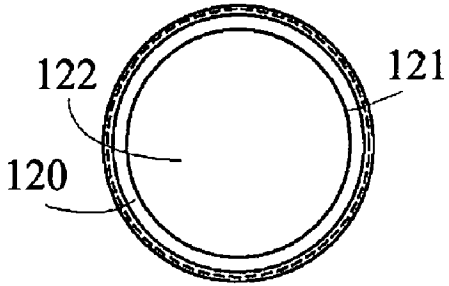
FIG. 12
(Prior Art)
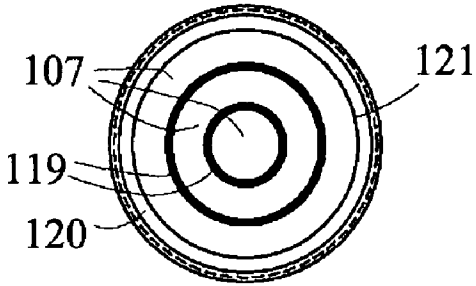
FIG. 13
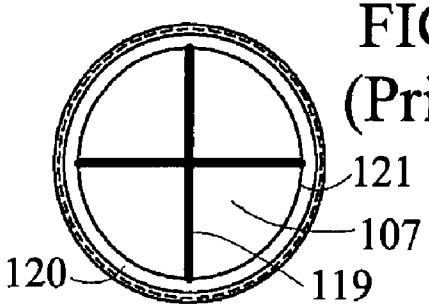
FIG. 14
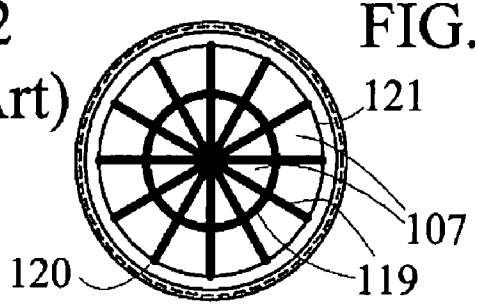
FIG. 15
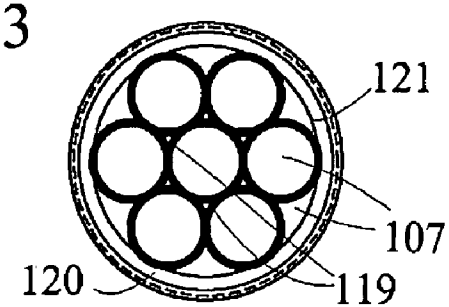
FIG. 16

FIREARM PROJECTILE APPARATUS, METHOD, AND PRODUCT BY PROCESS

TECHNICAL FIELD

This invention relates generally to the field of firearms projectiles, and specifically to projectiles for use in, though not limited to use in, muzzle (front)-loading firearms.

BACKGROUND ART

To function most efficiently, muzzle loading firearms preferably have a projectile and a wad or gas check member between the projectile and the powder charge. In the early years of muzzleloaders, a lead projectile was ram-rodded down the bore of the firearm for placement over a powder charge. The diameter of the projectile, of necessity, exceeded the diameter of the bore for holding the projectile in place within the bore.

Later in the history of muzzleloaders came ordnance in which the wad was directly attached to the ball or bullet as typified by U.S. Pat. No. 35,273, issued to E. D. Williams and U.S. Pat. No. 43,017 issued to G. P. Ganster.

Since the early inventions, it has become common to use sabots or wrappers, surrounding the bullet, to engage the bore of the firearm to hold the projectile in place and, where the bore is rifled, to impart spin to the bullet. Such wrappers are conventionally made of expansive packing such a molding paper, leather or the like, as typified by U.S. Pat. No. 34,950, issued to C. T. James and U.S. Pat. No. 405,690, issued to A. Ball.

More recently it has been accepted practice to attach a discarding gas check directly to the base of the projectile. The gas check is typically made of resilient plastic material and has a diameter slightly greater than the minimum accepted barrel bore size. The attached projectile has a diameter less than minimum bore size, providing for a loose fit in the barrel bore. U.S. Pat. Nos. 5,458,064 and 5,621,187 are typical in this regard, and include a single recess in the rear of the gas check into which the powder charge often enters.

Primary disadvantages of known projectiles for muzzleloaders relate to dimensions of the bullet, placement of the gas check member, and the inability to keep the powder charge out of the gas check in a controlled manner.

Where the bullet's maximum diameter exceeds that of the bore of the firearm, scoring of the bullet from its contact with the rifling as well as deformation of the bullet from the rod-ramming process results, causing degeneration of the ballistic qualities of the bullet. Additionally, because of the contact between bore and bullet, the firearm is more difficult to load, thereby impeding the loading process when a follow-up shot may be needed in a hurry. Yet, some degree of engraving is desirable to improve ballistic performance.

Where wrappers or sabots are used to surround the bullet, such wrapper itself engages both bullet and bore and is indeed required where rifling of the bore is intended to impart spin to the wrapper and hence the bullet. Such wrapping, however, in surrounding the bullet and hence being located between bullet and bore, results in interference between the bullet and the bore, adversely affecting the ballistic qualities of the bullet exiting the bore. It also prevents the bullet from being properly engraved with the firearm rifling pattern.

Projectile diameters of less than bore size result in accuracy issues and possible hazard and extremely dangerous situations to shooters and bystanders.

Projectiles exiting bore without being engraved with the rifling and any projectile which is discarding gas checks, sabot or wrappers in flight are susceptible to inaccuracy in flight and inconsistent downrange ballistic performance.

It is therefore desirable to provide a projectile with at least part of its diameter greater than the bore of the firearm into which it is inserted, which can thereby gain the benefit of being engraved with the rifling of the bore through which it will be discharged while nevertheless avoiding the difficulties encountered with such greater-diameter bullets known in the prior art.

It is also desirable to provide a controlled air space to enhance propellant burn, to ensure integrity of this controlled air space to avoid its deformation during loading and firing, and to yield a consistent ballistic result from one firing to the next.

It is also desirable to have a pressure shield attachable to the bullet to ensure positive placement of projectile relative to the propellant and to ensure consistent pressures and increased velocities, while avoiding undesired entry of powder into the gas check.

It is also desirable to improve stability and uniform bullet flight without the adverse effect of a sabot, wrapper, or gas check being discarded.

It is also desirable to provide a projectile which is user friendly, which may be loaded and discharged with quick response time, and which is convenient to carry and handle.

It is further desirable to provide a means for expanding the projectile on impact, for increasing the length of the projectile to improve ballistic performance without a substantial increase in weight, for managing projectile weight, and for easily engraving the projectile with the bore rifling.

MODE FOR THE INVENTION

A firearm projectile assembly apparatus disclosed herein comprises: a bullet; a hollow core running completely through the bullet from a front of the bullet subassembly to a rear of the bullet; a core material within at least part of the hollow core; and an expansion-inducing tip integral with the core material, and protruding forward of the front of the bullet; wherein: when the projectile assembly impacts with a target, the expansion-inducing tip drives the core material rearward relative to the hollow core, forcing the bullet to expand radially outwardly.

Also disclosed for firearm projectile assembly apparatus is a pressure shield; and a non-discarding attachment of the pressure shield to the bullet, such that after the projectile assembly is fired from a firearm, the pressure shield does not discard from the bullet during the bullet's flight to a target. Also disclosed is a pressure shield comprising: a gas check; and various controlled air spaces.

Also disclosed are related methods of use and production for the firearm projectile assembly apparatus, and various subassemblies thereof.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

FIG. 11 is a table illustrating, by way of example, not limitation, possible key diameters for the projectile assembly of FIGS. 5 and 8.

FIG. 12 illustrates a plan view of a gas check in accordance with the prior art.

FIG. 13 illustrates a pressure shield providing controlled air spaces in one invention embodiment.

FIGS. 14-16 illustrate a pressure shield providing controlled air spaces and structural integrity in several alternative preferred embodiments.

DISCLOSURE OF INVENTION

Figure 1:
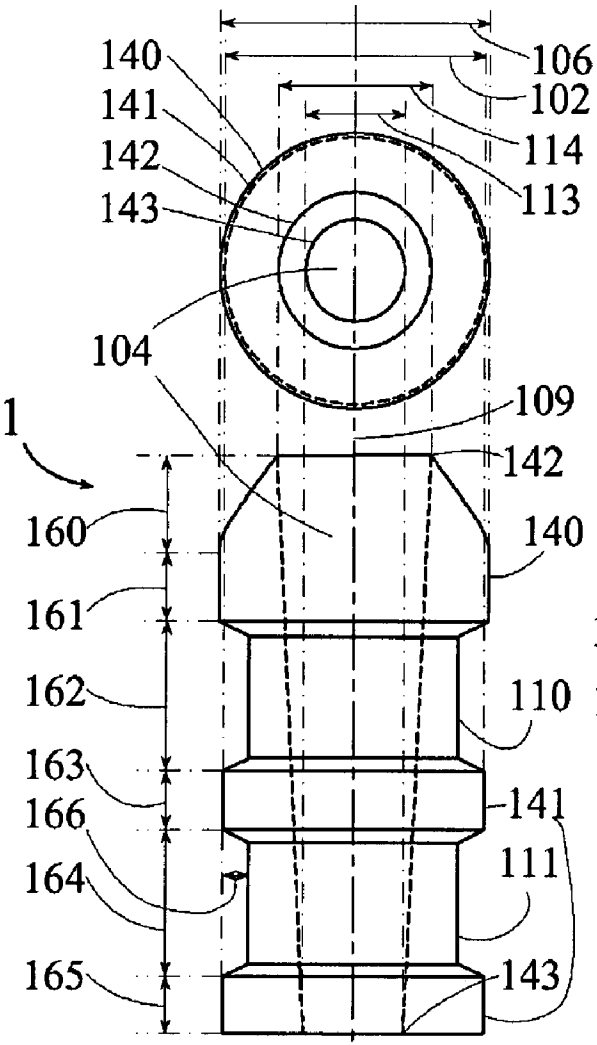
FIG. 1 illustrates side and top (front/forward) projection plan views of a bullet subassembly in a preferred embodiment of the invention.
Figure 5:
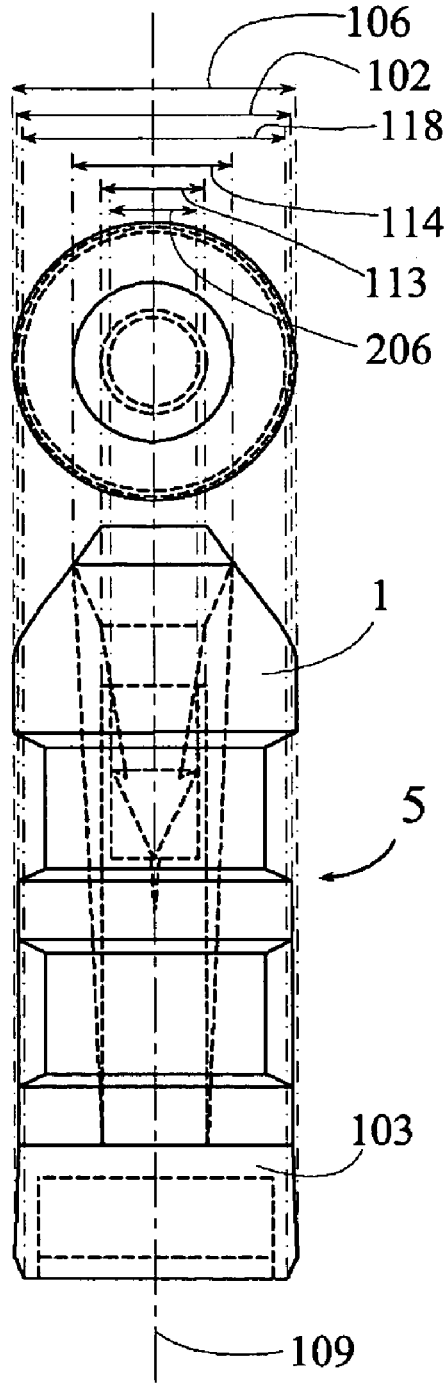
FIG. 5 illustrates side and top projection plan views of the assembled projectile assembly in a preferred embodiment of the invention.

FIG. 1 illustrates a bullet subassembly 1 in a preferred embodiment of the invention, prior to its assembly into the projectile assembly 5 illustrated in FIG. 5. Bullet subassembly 1 comprises any suitable obturating bullet material known or which may become known in the art such as, but not limited to, lead or copper and varying combinations thereof.

Bullet subassembly 1 comprises a hollow core 104 (dynamically expanding dyno-core™) running completely through bullet subassembly 1 from front to a rear, substantially symmetrically about a longitudinal center axis 109 thereof. Preferably, a front core diameter 114 of the front 142 of hollow core 104 proximate the front of bullet subassembly 1 is greater than a rear core diameter 113 of the rear 143 of hollow core 104 proximate the rear of bullet subassembly 1, as illustrated. Preferably, the cross sectional diameter of hollow core 104 increases progressively from the rear of bullet subassembly 1 to the front of bullet subassembly 1, also as illustrated. It is further preferable that the diameter 114 at the front 142 of hollow core 104 exceed the diameter 113 the rear 143 of hollow core 104 by at least fifty percent. As will be elaborated later, hollow core 104 assists projectile assembly 5 to dynamically expand upon impact with a target.

Bullet subassembly 1 also comprises circumferential belts, such as but not limited to front circumferential belt 110 and rear circumferential belt 111, circumscribing part of bullet subassembly 1 substantially symmetrically about longitudinal center axis 109, as illustrated. These circumferential belts, e.g., 110 and 111, substantially reduce the projectile assembly surface area to be engraved at loading, thereby minimizing deformation of bullet 1 during loading and minimizing loading impedance. The result is enhanced ballistic integrity. The depth of these circumferential belts may be varied at will, thus enabling control over the weight of bullet subassembly 1 and consequently of projectile assembly 5, as will be discussed later in more depth.

Bullet subassembly 1, toward the center and rear regions thereof, as illustrated, also comprises a primary bullet diameter 141 of dimension designated 102. Bullet subassembly 1, towards it front, also comprises a bullet engraving surface 140 of dimension designated 106 which is slightly larger than dimension 102. As a result, the projection of primary bullet diameter 141 is hidden (broken dashed lines, to be similarly used throughout) in the front projection view of FIG. 1. Primary bullet diameter 141, the magnitude of which is designated by 102, is selected to approximate the bore diameter (particularly the "land") 154 (see FIGS. 9 and 10) of the firearm barrel 9 in which bullet subassembly 1 is intended to be used. Bullet engraving surface 140, the dimension of which is designated by 106, is selected to approximate the (larger) diameter of rifling "grooves" 155 of the firearm barrel in which bullet subassembly 1 is intended to be used. As will be elaborated later, the slightly-larger-diameter bullet engraving surface 140 enables suitable rifling engraving of projectile assembly 5 during firearm loading, while the slightly-smaller primary bullet diameter 141 combines with circumferential belts 110, 111 to reduce the projectile assembly surface area engraved at loading, thereby providing necessary engraving which minimizing loading impedance.

Figure 2:
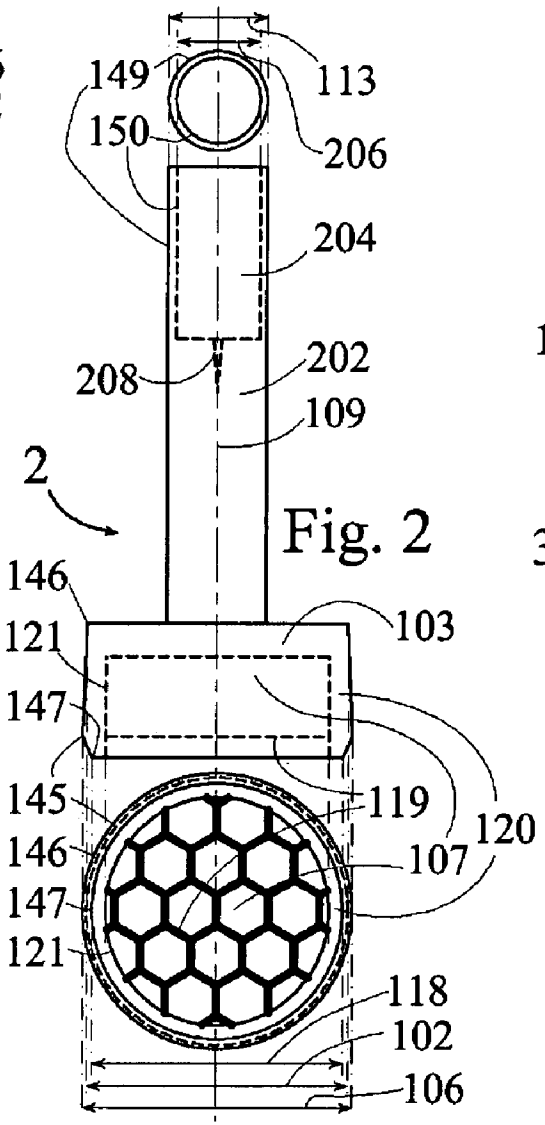
FIG. 2 illustrates side, top projection and bottom (rear) projection plan views of a pressure shield subassembly in a preferred embodiment of the invention.
Figure 4:
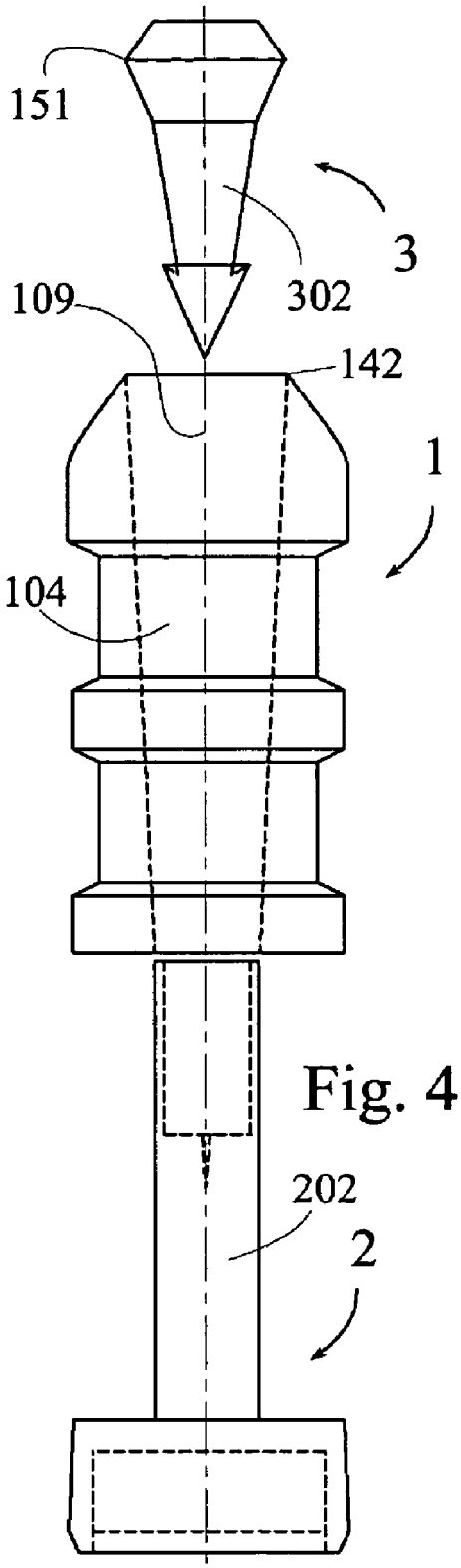
FIG. 4 is a side plan view schematically illustrating the assembly of the bullet, pressure shield subassembly, and expansion tip subassembly of FIGS. 1-3 into a projectile assembly in a preferred embodiment of the invention.

FIG. 2 illustrates pressure shield subassembly 2 in a preferred embodiment of the invention, prior to its assembly into the projectile assembly 5 illustrated in FIG. 5. Pressure shield subassembly 2 comprises a pressure shield 103 integrally attached to a pressure shield mating extension 202. It is to be observed that the outer diameter 149 of pressure shield mating extension 202 is substantially equal to rear core diameter 143 discussed in FIG. 1 above. Both of these have an approximate dimension designated by 113. This enables pressure shield mating extension 202 to be inserted into and seated firmly within the rear of hollow core 104 of bullet subassembly 1, as illustrated in FIG. 4. As a consequence, after assembly with bullet subassembly 1, pressure shield 103 will be situated just behind bullet subassembly 1, as shown in FIG. 5.

Looking at the bottom projection view of FIG. 2, it is to be observed that the outer perimeter of pressure shield 103 comprises a circular gas check 120 similar to gas checks widely-known in the art. Gas check 120, of course, is what transfers the explosive force from the powder charge 10 (see FIG. 10) to the projectile 5 when the charge is ignited. Pressure shield 103 is integrally attached proximate the rear of pressure shield mating extension 202, with a rearward-orientation of gas check 120, as illustrated in FIG. 2. This is one way to ensure that gas check 120 is non-discarding, as will be discussed further below.

Figure 10:
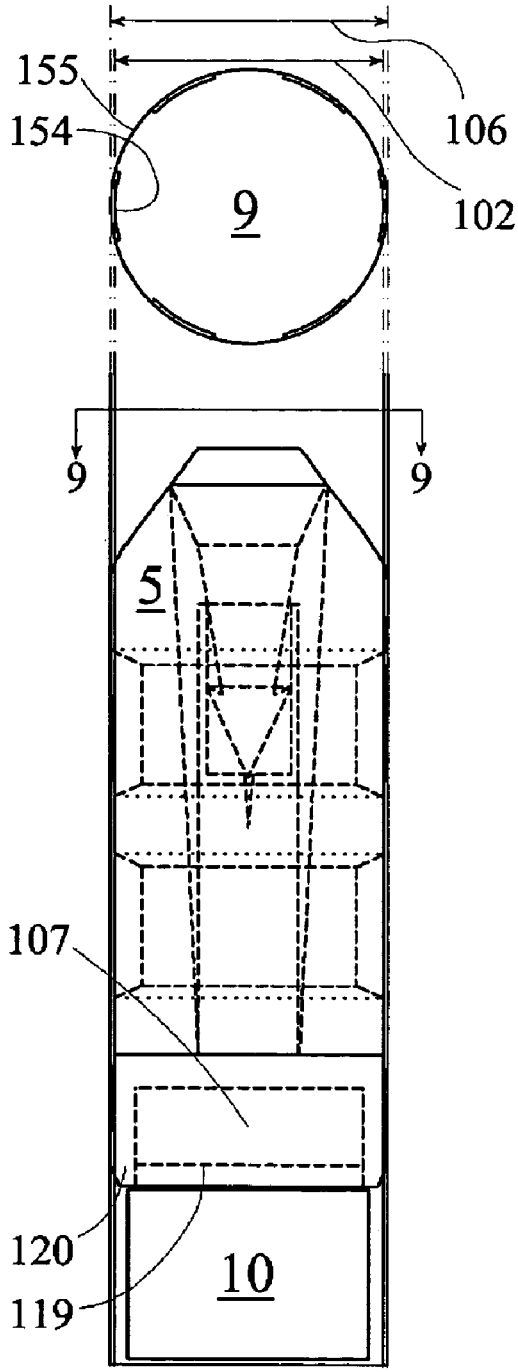
FIG. 10 illustrates a side plan view of the projectile of FIG. 8 after it has been loaded into the firearm bore and is in position to be fired.

Importantly, pressure shield also comprises a controlled air space comprising powder-excluding protrusions 119 as well as air recesses 107 amidst powder-excluding protrusions 119. As illustrated, powder-excluding protrusions 119 form a honeycomb in the preferred embodiment of FIG. 2. However, other alternate preferred embodiments such as those to be illustrated and discussed later in FIGS. 13-16 can also be employed within the scope of this disclosure and its associated claims. The simple "+" (plus) or "x" configuration of FIG. 14, for example, is easily manufactured and thus also a preferred configuration. When projectile 5 is loaded into the firearm in front of the powder charge 10 as shown in FIG. 10, powder-excluding protrusions 119 keep powder out of air recesses 107, enabling air recesses 107 to maintain the airspace needed for proper oxidation and burning of the powder when the firearm is fired.

Also, importantly, powder-excluding protrusions 119 are directly connected to the inner wall 121 of gas check 120. These in structural connections, through powder-excluding protrusions 119, among a plurality of locations on inner wall 121, maintain the structural integrity of gas check 120 when the firearm is fired. Without such structural integrity, gas check 120 can easily be bent and distorted during loading or firing, resulting in the inconsistent, inaccurate ballistic results often associated with prior art muzzle-loaded firearms.

The front 146 of pressure shield 103 has a pressure shield front diameter 102 approximately equal to the primary bullet diameter 141 (also dimension 102), which in turn are both approximately equal to the diameter (also 102, see FIGS. 9 and 10) of land 154. Moving rearward, the cross-sectional diameter of pressure shield 103 increases progressively (skirts out) to a pressure shield maximum diameter 145 of magnitude 106, which is approximately equal to the diameter (also 106) of the bullet engraving surface 140 of bullet 1, and which are in turn both approximately equal to the diameter (also 106, see FIGS. 9 and 10) of rifling grooves 155. (As will be discussed later in connection with FIG. 11, it is helpful, though not required, to provide a very slightly smaller diameter for bullet engraving surface 140 than for pressure shield maximum diameter 145.) Moving further rearward, the diameter of pressure shield 103 progressively decreases (boat tails) to reach a pressure shield rear diameter 147 of magnitude 118. Magnitude 118 is smaller than the magnitude 102 of bore land 154, see FIG. 9.

Pressure shield mating extension 202 further comprises a mating receptacle 204 with mating receptacle inner diameter 150 of magnitude designated by 206. Also illustrated is an optional expansion scoring 208 which aids in bullet expansion particularly where rapid expansion is desired. As will be seen below, mating receptacle 204 mates with expansion tip mating extension 302 of expansion tip subassembly 3 to be discussed next in connection with FIG. 3 and among other benefit, causes pressure shield 103 to be non-discarding.

Figure 3:
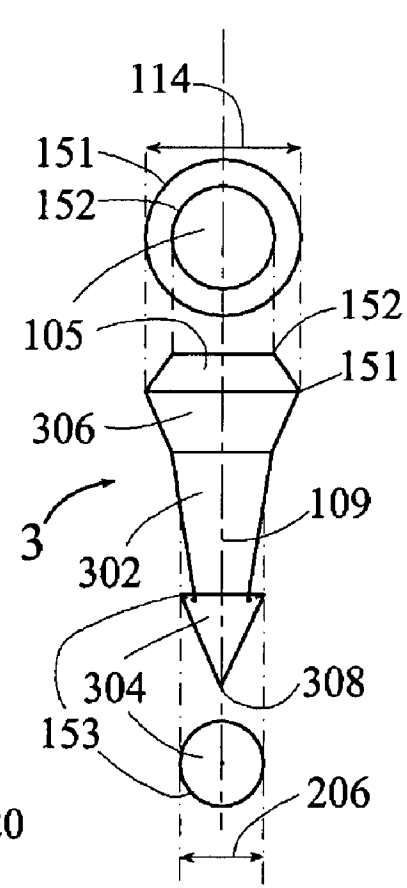
FIG. 3 illustrates side, top projection and bottom projection plan views of a expansion tip subassembly in a preferred embodiment of the invention.

FIG. 3 illustrates expansion tip subassembly 3 in a preferred embodiment of the invention. Expansion tip subassembly 3 comprises expansion-inducing tip 105, which reaches a maximum tip diameter 151 of magnitude 114 substantially equal to front core diameter 142 discussed earlier. Moving toward the rear of expansion tip subassembly 3 from maximum tip diameter 151, expansion tip subassembly 3 further comprising a driving wedge 306. During the assembly shown in FIG. 4 of projectile assembly 5 shown in FIG. 5, expansion tip subassembly 3 is ultimately inserted into the front of hollow core 104 of bullet subassembly 1 such that the maximum tip diameter 151 butts with front core diameter 142, each of which is approximately equal to the magnitude designated as 114 in FIGS. 1, 3 and 5. Then, when projectile assembly 5 is later fired and strikes its target, expansion-inducing tip 105 drives backwards into hollow core 104 and driving wedge 306 forces bullet subassembly 1 to expand while passing through the target.

Expansion tip subassembly 3 also comprises an expansion tip mating extension 302 which, in the illustrated preferred embodiment, terminates rearwardly in a mating and driving head 304. The maximum mating and driving head diameter 153, with magnitude designated 206 is substantially equal to the diameter of mating receptacle inner diameter 150 of pressure shield mating extension 202, also with designated dimension 206, just discussed. This substantial equivalence between mating receptacle inner diameter 150 and maximum mating and driving head diameter 153, combined with the "prong" formed by mating and driving head 304 at the maximum diameter region 153, enables expansion tip subassembly 3 to mate firmly with pressure shield subassembly 2 as shown in FIG. 5, and as shown without bullet subassembly 1 in FIG. 6. Particularly, the prong biases relative movement between pressure shield subassembly 2 and expansion tip subassembly 3 such that they are more readily pushed together than drawn apart. Further, an acutely-angled tip 308 of mating and driving head 304 allows mating and driving head 304 to drive through pressure shield mating extension 202 at the point of contact 62 (see FIGS. 6 and 7) between the mating and driving head 304 and the pressure shield mating extension 202. The optional scoring 208 creates a weakening in pressure shield mating extension 202 which enables acutely-angled tip 308 to drive more readily through the body of pressure shield mating extension 202 when projectile assembly 5 strikes a target, thus accelerating the expansion of projectile assembly 5 after impact.

Figure 7:
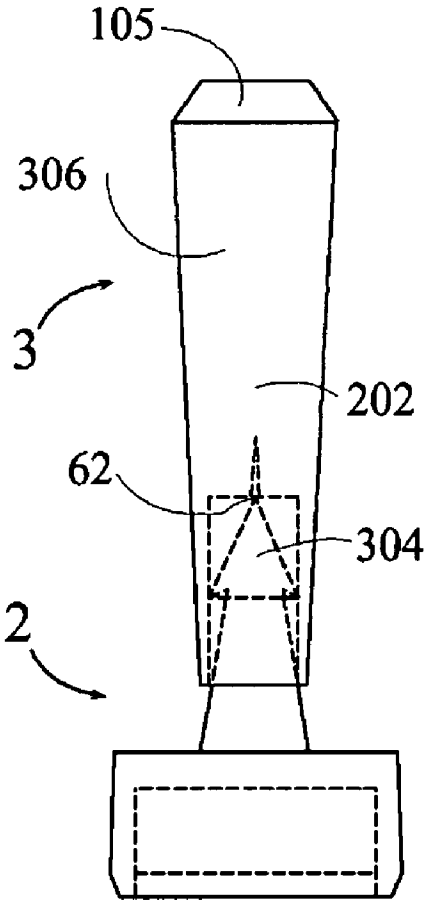
FIG. 7 illustrates the mating of the pressure shield subassembly of FIG. 2 with the expansion tip subassembly of FIG. 3, with the male and female mating units reversed, and with the expansion tip subassembly configured to control expansion of the projectile assembly on impact with a target.
Figure 6:
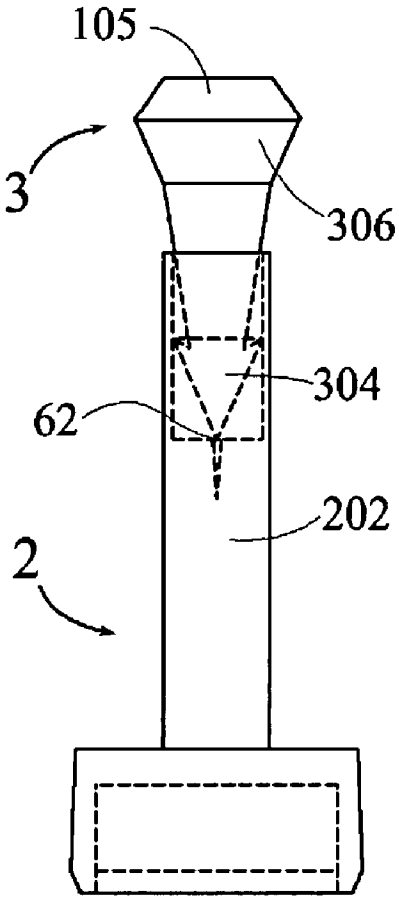
FIG. 6 illustrates the mating of the pressure shield subassembly of FIG. 2 with the expansion tip subassembly of FIG. 3.

Note from FIGS. 6 and 7, that the mating components of pressure shield subassembly 2 and expansion tip subassembly 3 may be readily reversed within the scope of this disclosure and its associated claims, and indeed, that a wide variety of devices and methods can be used to mate pressure shield subassembly 2 with expansion tip subassembly 3 within the scope of this disclosure and its associated claims. It is noted that expansion tip subassembly 3 in FIG. 7, however, has a taper which matches that of hollow core 104 of bullet subassembly 1. As will be discussed later, this configuration also affects the expansion of projectile assembly 5 after impact, and is actually used to delay—rather than accelerate—the expansion of projectile assembly 5 to penetrate thicker-skinned targets.

FIG. 4 illustrates the assembly of bullet subassembly 1, pressure shield subassembly 2, and expansion tip subassembly 3 into the projectile assembly 5 of FIG. 5. The assembly comprises the steps of: fabricating bullet subassembly 1; fabricating pressure shield subassembly 2; fabricating expansion tip subassembly 3; inserting pressure shield mating extension 202 into the rear of the hollow core 104 of bullet subassembly 1; inserting expansion tip mating extension 302 into the front of the hollow core 104; and mating pressure shield mating extension 202 with expansion tip mating extension 302. The projectile assembly 5 which results as the end-product of this process, is illustrated in FIG. 5.

A wide variety of approaches can be taken to fabricate each of bullet subassembly 1, pressure shield subassembly 2, and expansion tip subassembly 3. Materials can be varied for density and hardness and deformation ability depending on the use envisioned for the projectile assembly 5 being assembled. Each subassembly may be cast separately and then assembled. Bullet assembly 1 may be cast in a mold and then further processed (e.g., shaved) to achieve exact tolerances. Because hollow core 104 expands in diameter from rear to front, the separate fabrication, insertion and mating of pressure shield subassembly 2 and expansion tip subassembly 3 as illustrated greatly simplifies modular production. However, pressure shield subassembly 2 and expansion tip subassembly 3 and also be manufactures in a unitary assembly, as discussed later in connection with FIG. 18.

A protective lubricant 8, such as but not limited to Wonder Lube™ 1000 Plus™ by Ox-Yoke Originals, Inc., or any similar product known or which may become known in the at, is preferably added to fill circumferential belts 110, 111 in the manner customary for filling the belts of belted projectiles. Protective lubricant 8 serves to ease the loading of projectile assembly 5 into the firearm barrel, and protects the barrel from fouling and corrosion.

Figure 8:
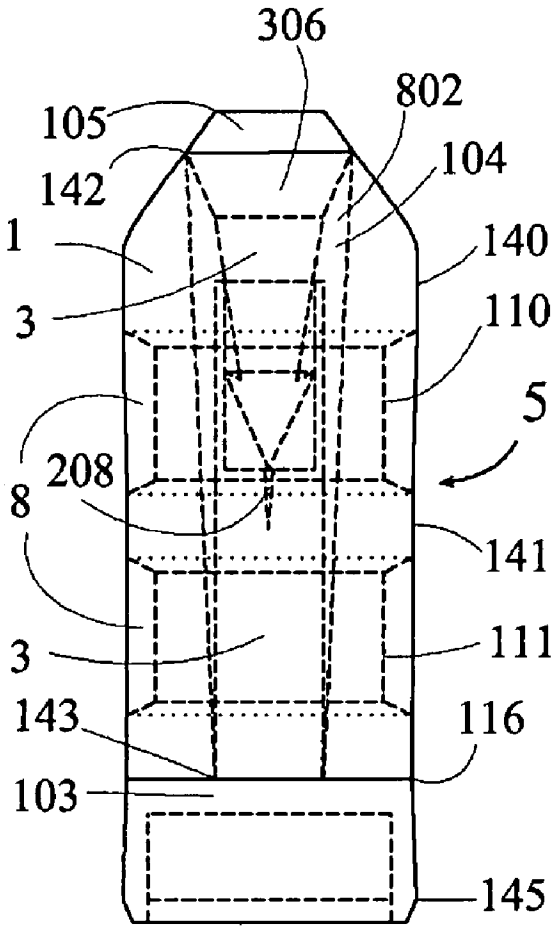
FIG. 8 illustrates side and top projection plan views of the assembled projectile assembly in a preferred embodiment of the invention, with protective lubricant applied to circumferential belts of the projectile assembly.

FIG. 8 thus illustrates a fully assembled a projectile assembly 5 in a preferred embodiment of the invention, including protective lubricant 8, employing the various subassemblies disclosed above and assembled according to the methods disclosed above. While the above discussion illustrates preferred embodiments, there may be other methods apparent to someone of ordinary skill for arriving at a projectile assembly with essentially the same characteristics as the projectile assembly 5 described above, and such similar or equivalent projectile assemblies—even if they differ in terms of the specifics of their subassemblies and how they are assembled—are still regarded to be within the scope of this disclosure and their associated claims. One such example will be elaborated later in connection with FIG. 17. Given the range of possible configurations which may be used to achieve the various improvements disclosed herein, discussion to follow will be cast in these more general terms, without relying on the specific three-piece assembly disclosed above.

In general terms, projectile assembly 5 comprises: a bullet 1 comprising any suitable obturating bullet material known or which may become known in the art such as, but not limited to, lead or copper. It comprises a comprising a bullet engraving surface 140 approximately equal to a diameter 106 of rifling grooves 155 of the firearm barrel 9 in the bullet subassembly 5 is intended to be used. It comprises a pressure shield 103 which is located to the rear of the bullet assembly 5 and which attaches integrally to the bullet 1. It comprises a dynamically expanding hollow core 104 (dyno-core™) with an expansion-inducing tip 105 (nitro-expansion-tip™) at the front end of projectile assembly 5 which induces the dynamic expansion. Pressure shield 103 comprises a pressure shield maximum diameter 145 approximately equal in magnitude 106 to bullet engraving surface 140 of bullet 1 and hence of the intended rifling 155, and thus approximately equal in magnitude to the diameter, also 106, of bullet engraving surface 140. As noted above and discussed in FIG. 11, it is actually helpful to provide a very slightly smaller diameter for bullet engraving surface 140 than for pressure shield maximum diameter 145. Pressure shield 103 comprises controlled air spaces 107 to provide a controlled pressure chamber for consistent positioning of projectile assembly 5 relative to a powder charge 10, which yields accelerated burn rate, and increased pressure and velocity. And, pressure shield 103 is non-discarding, though the various improvements disclosed herein can also be employed in connection with a discarding pressure shield.

Projectile assembly 5 is specifically designed for muzzle-loading firearms, though its use is not limited to muzzle-loading firearms. Projectile assembly 5 comprises bullet 1, and pressure shield 103 which is fabricated (FIG. 17) or assembled (FIG. 4) integrally with dynamically expanding hollow core 104 and expansion-inducing tip 105. Dynamically expanding hollow core 104 is contained concentrically within bullet 1 as illustrated. Pressure shield 103, dynamically expanding hollow core 104 and expansion-inducing tip 105 preferably comprise a resilient plastic, wax (preferably hard wax), or similar material such as, but not limited to, aluminum, titanium, and other suitable materials. The choice of materials as discussed below will depend on the intended use of projectile assembly 5. As noted above, bullet 1 has a bullet engraving surface 140 approximately equal in magnitude 106 to (or very slightly less than) pressure shield maximum diameter 145 and to the diameter of intended rifling 155. This is to ensure concentric engraving of bullet 1 during the loading procedure, thus improving uniform expansion of bullet subassembly 1 and enhancing accuracy. These diameters in turn are slightly greater than the diameters 102 of the primary bullet diameter 141 and of land 154. This ensures proper engraving at both the front and the rear of the overall projectile assembly 1, as well as a snug, concentric, positive retention against the powder charge 10. At the same time, the reduced "waist" of projectile assembly 5, comprising primary bullet diameter 141 of bullet 1 with reduced diameter 102, reduces the surface area for engraving and thus reduces loading impedance.

Additionally, circumferential belts, such as but not limited to a front circumferential belt 110 and a rear circumferential belt 111, wrap part of the outside body of projectile assembly 5, further substantially reducing the projectile assembly surface area to be engraved at loading, minimizing, deformation of bullet 1 during loading and minimizing loading impedance, and enabling controlled weight reduction and enhanced ballistic integrity. Protective lubricant 8 coats bore 9 to ease loading and engraving, reduce barrel fouling and substantially ease the firearm cleaning process. In short, these various features combine to yield proper engraving and concentric seating, simultaneously with low loading impedance.

Pressure-shield 103 is integrally connected to dynamically expanding hollow core 104 and expansion-inducing tip 105, thus comprising a non-discarding design. Expansion-inducing tip 105 resists deformation during the loading process because of its flat head design and the selection of materials from which it is fabricated, and adds flight stability and enhances instantaneous expansion upon impact via rearward compression of dynamically expanding hollow core 104.

Figure 9:
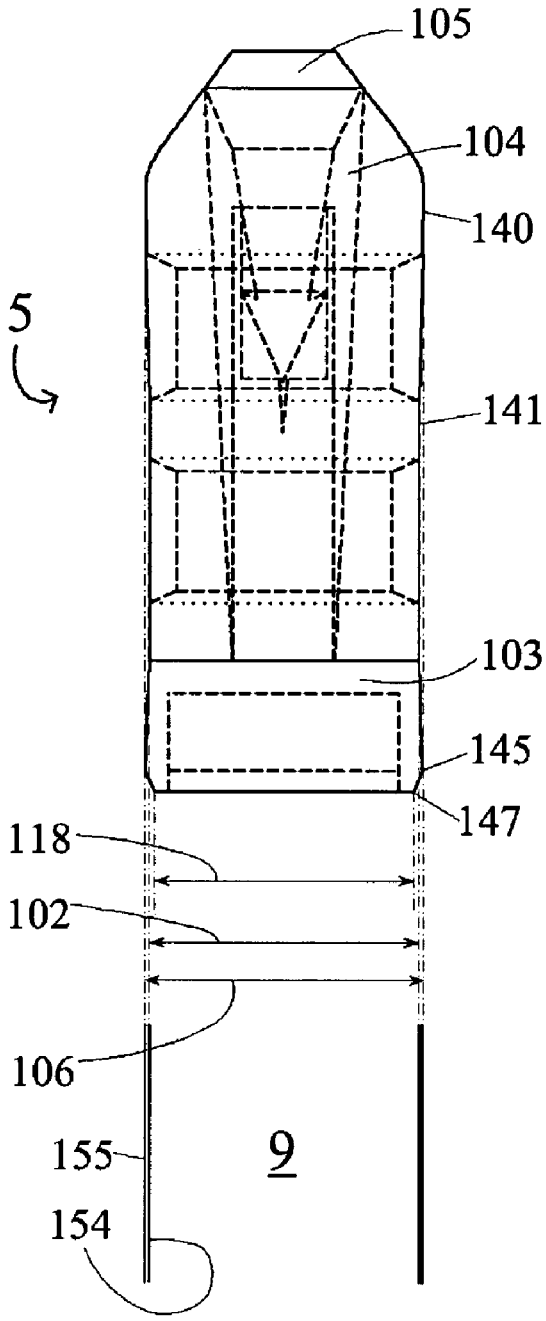
FIG. 9 illustrates a side plan view of the projectile of FIG. 8 as it is about to be loaded into the front end of a firearm bore.

Referring now to FIG. 9, to load a muzzle-loading firearm with projectile assembly 5, projectile assembly 5 including the belted 110, 111 bullet 1 and integrally connected pressure shield 103, dynamically expanding hollow core 104 and expansion-inducing tip 105 are loaded through the front of the bore 9. The wider bullet engraving surface 140 and pressure shield maximum diameter 145, both of approximate dimension 106, are selected to approximate the diameter of rifling groove 155 but to be larger than the diameter of land diameter. Thus, they are engraved and serve also to seat projectile assembly firmly within the barrel 9. As noted earlier, the reduced primary bullet diameter 141 ("waist") of projectile assembly 5, of dimension 102, is not quite wide enough to be engraved, and this reduces loading impedance. All of this improves the ballistics of projectile assembly 5, because projectile assembly 5 is well engraved for spinning and is properly seated for firing. Pressure shield 103, with its enlarged pressure shield maximum diameter 106, ensures proper placement and retention of projectile assembly 5 relative to a powder charge 10 which resides to the rear of projectile assembly 5 within the firearm chamber (see FIG. 10). Both pressure shield 103 and the engraved region 140 of bullet 1 frictionally and resiliently ensure safe retention, increased pressure, and accelerated velocity, while the dynamically expanding hollow core 104 and expansion-inducing tip 105 enhance bullet 1 expansion upon impact. Because pressure-shield 103 is non-discarding, the flight of projectile assembly 5 is not interrupted with discarding components, which improves flight and ballistic integrity, as well as safety. We now turn to examine these various features individually in further detail.

First, we examine dynamically expanding hollow core 104 and expansion-inducing tip 105. First, referring to FIG. 8, it is to observed again that rear core diameter 143 is somewhat smaller than front core diameter 142 proximate expansion-inducing tip 105, and that the core diameter increases progressively from rear to front (or, decreases progressively from front to rear). Second, it is to be noted that expansion-inducing tip 105 protrudes forward of the front end of bullet 1. Third, it is noted that the material (generally 3, whether a modular subassembly or not) within dynamically expanding hollow core 104 and expansion-inducing tip 105 comprise a plastic, wax, aluminum, titanium, or similar core material, whereas bullet 1 comprises any suitable obturating bullet material such as lead or copper or varying compositions thereof. That is, the core material 2 and expansion-inducing tip 105 comprise a material different from the obturating bullet material. Particularly, bullet 1 is preferably harder and denser than core material 3 and expansion-inducing tip 105. Fourth, it will be noted that dynamically expanding hollow core 104 is not completely filled with expansion tip subassembly/core material 3, but (optionally, in contract to FIG. 17) maintains an unfilled chamber cavity 802. These factors combine to yield a number of functional benefits.

After firing, when projectile assembly 5 impacts its target at high speed, expansion-inducing tip 105 is suddenly compressed toward the rear of projectile assembly 5. The material comprising expansion-inducing tip 105 along with driving wedge 306 (part of expansion tip subassembly/core material 3) thus recedes into the dynamically expanding hollow core 104, forcing bullet 1 to expand radially outwardly, producing a dynamic expansion of bullet 1 on target impact. The fact that the core diameter is progressively reduced from front to rear, further predisposes bullet 1 to, and enhances, this dynamic expansion. At this point, we are ready to explore a number of factors which can be used to control this dynamic expansion.

In some situations, if projectile assembly 5 is not made sensitive enough to trigger expansion, it can pass right through a target without ever expanding at all. Conversely, if it is overly-sensitive, it may strike the target, expand before entering the target, and simply bounce off with little impact. This is a know problem in the prior art. For thick-skinned game, for example, it is important to be able to delay the expansion, to ensure that projectile assembly 5 has first penetrated its target, while for a thin-skinned target offering little resistance, much greater sensitivity is required. These question then becomes, how does one control the expansion in response to impact?

Figure 17:
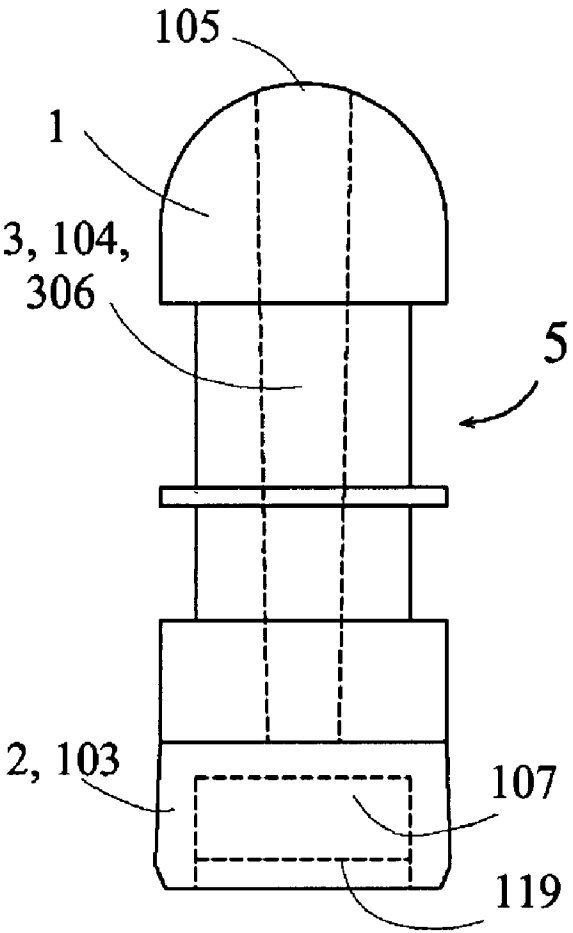
FIG. 17 is a plan view, illustrating the projectile assembly of FIG. 4 in an alternative embodiment of the invention.

Contrasting FIG. 8 (and FIG. 6) with FIG. 17 (and FIG. 7), we note that in FIG. 8, dynamically expanding hollow core 104 comprises an unfilled chamber cavity 802, whereas in FIG. 17 dynamically expanding hollow core 104 is completely filled by expansion tip subassembly/core material 3. Unfilled chamber cavity 802 makes the embodiment of FIG. 8 more sensitive to expand on impact, because there is nothing but empty space to impede the rearward action of driving wedge 306. In FIG. 17, because expansion tip subassembly/core material 3 butts against the entire inner surface of dynamically expanding hollow core 104, there is a rearward impedance, which will slow the expansion response on impact. Thus, a configuration such as that of FIG. 17 (and an expansion tip subassembly 3 such as that in FIG. 7) is more suitable for a target which is more resistant to penetration and might prematurely cause expansion, while a configuration such as that of FIG. 8 (and an expansion tip subassembly 3 such as that in FIG. 6) is more sensitive to impact, will expand very rapidly following impact, and thus is less prone to pass through a target without expansion. Hence, it is suitable for a softer target. The choice of a FIG. 8 versus a FIG. 17 configuration—or some hybrid of the two, thus depends on the intended targets.

Optional expansion scoring 208 also affects expansion. In a circumstance where rapid expansion highly sensitive to impact is desired, one may employ such a pre-scored weakness in pressure shield subassembly 2 to ensure that acutely-angled tip 308 of mating and driving head 304 penetrates rapidly into pressure shield subassembly 2, splitting pressure shield subassembly 2 like an axe driving through the grain line of wood, and causing rapid outward expansion over the entire length of bullet subassembly 1. Where less sensitive expansion is desired, one would omit the optional expansion scoring 208.

Choice of materials—particularly hardness and softness—also impacts the sensitivity of expansion. If pressure shield subassembly 2 comprises a relatively hard material, then it will resist penetration by acutely-angled tip 308 and expansion will be delayed. If pressure shield subassembly 2 is softer and more yielding, expansion will be more rapid. So too, the sharpness or bluntness of acutely-angled tip 308 can affect expansion rate, as can the precise spatial configuration of unfilled chamber cavity 802, if any. The upshot is that great deal of control is achieved over the sensitivity of bullet subassembly 1 to expand on impact, and that different munitions can be manufactured accordingly for different types of target.

Because core material 3 which is different from (and preferably less dense than) bullet 1, it is possible for a projectile assembly 5 of a predetermined caliber (intended bore 9 diameter) and predetermined weight to be made longer relative to its diameter, which, as will be obvious to someone of ordinary skill, improves the ballistic accuracy of projectile assembly 5. That is, a projectile assembly 5 of a given caliber and weight can be made longer to improve ballistic accuracy. The protective lubricant 8 in circumferential belts 110, 111, also comprises a different, preferably softer and less-dense belt material than bullet 1, which enables further elongation of a given caliber and weight projectile assembly 5, and more generally, provides latitude for adjusting both the weight and the length of projectile assembly 5.

Next, we turn to examine pressure shield 103 in further detail. First, it is to be noted that at a pressure shield-to-bullet juncture 116 (see FIG. 8) where bullet 1 adjoins pressure shield 103 around an outer circumference of projectile assembly 5, the front 146 diameter of pressure shield 103 is substantially identical to the rear diameter 141 of bullet 1, each with a magnitude designated by 102, see FIGS. 1 and 2. That is, the outer circumferences of bullet 1 and pressure shield 103 flow substantially smoothly and continuously together at pressure shield-to-bullet juncture 116. Second, moving from pressure shield-to-bullet juncture 116 rearward, the pressure shield diameter of pressure shield 103 increases progressively (skirts out) from dimension 102 to dimension 106 at pressure shield maximum diameter 145. Third, moving from pressure shield maximum diameter 145 further rearward, the diameter of pressure shield 103 progressively decreases (boat tails) to reach a pressure shield rear diameter 147 of dimension 118 at the rear of projectile assembly 5. Pressure shield rear diameter 147 dimension 118, importantly, is smaller than the land diameter 154 of the intended firearm bore 9, see FIG. 9. Finally, one should note the controlled air spaces 107 as well as powder-excluding protrusions 119 alternating therewith shown in the rear view of Figure two, and in the several other exemplary preferred embodiments for FIGS. 13 through 16. These features of pressure shield 103 result in a number of useful functional benefits that we shall now examine.

First, turning now to FIG. 9, it is to be noted that because pressure shield rear diameter 147 of magnitude 118 is smaller than the land diameter 154 of magnitude 102 of the intended firearm bore 9, the rear end of projectile assembly 5 is readily loaded into the front end of firearm bore 9 without resistance. That is, the boat tail rearward of pressure shield maximum diameter 145 facilitates loading of the rear end of projectile assembly 5 into the front end of firearm bore 9. In effect, the boat tail acts as a "shoehorn" to facilitate entry of projectile assembly 5 into firearm bore 9 and maintain concentric loading.

It is next to be noted that pressure shield maximum diameter 145 is greater than land diameter 154, as is the rear of the skirt region between pressure shield maximum diameter 145 and pressure shield-to-bullet juncture 116. Indeed, as noted earlier, pressure shield maximum diameter 145 is selected to match the rifling diameter 155, each of magnitude 106. Consequently, the outer circumference of pressure shield 103—which comprises a resilient plastic or similar material such as, but not limited to, woven fiber, cork (including composite cork), rubber, and similarly suited materials—is compressed once projectile assembly 5 is loaded into bore 9 (see FIG. 10), thus holding projectile assembly 5 firmly in place within bore 9, and also gaining some rifling etching. In particular, most of the pressure which holds projectile assembly 5 in a proper position and orientation within firearm bore 9 is pressure between the outer circumference of pressure shield 103 and the inner circumference of firearm bore 9. This is in addition to pressure between bullet engraving surface 140 of bullet 1 and bore 9 which is also used to etch rifling from bore 9 onto bullet 1 as well as to properly and concentrically seat bullet 1 within firearm bore 9.

Further, because of this tight fit between the outer circumference of the skirt region of pressure shield 103 and the inner circumference of bore 9, extending into the rifling 155, there are substantially no air spaces between where these two circumferences meet. So, when the powder charge 10 shown behind projectile assembly 5 in FIG. 10 detonates, all the explosive pressure is applied to the rear end of pressure shield 103 and hence projectile assembly 5, and does not "leak" through gaps between pressure shield 103 and firearm bore 9. By avoiding such leakage of the explosive pressure, all of the explosive pressure goes into imparting kinetic energy to projectile assembly 5, and the projectile assembly firing has a more controlled and consistent character that is not skewed by the vagaries of random air spaces between projectile assembly 5 and bore 9. This results in a more predictable and consistent ballistic result.

Additionally, a better ballistic result is achieved if there is a small, controlled air space between powder charge 10 and the rear of projectile assembly 5, than if the rear of the projectile assembly is crammed directly up against the powder charge 10 without any intervening air space. Further, it is clear that consistent management of this air space from one firing to the next will yield consistent ballistic results from one firing to the next. Conversely, if the air space is, configured differently from one firing to the next, then the ballistic result will also vary from one firing to the next, which is not desirable. For a non-muzzle-loading (e.g., breach-loading) firearm which employs a bullet preconfigured in combination with a shell and powder, this is less of a concern because the bullet/shell/powder unit is manufactured with a controlled air space and this can be consistently controlled from one unit to the next. But for muzzle-loading firearm, this is not the case because any air space is established by the loading process itself and so this air space needs to be established consistently from one loading to the next to contain consistent firing effects from one loading to the next. Thus, projectile assembly 5 itself needs to itself have features which create a suitable air space, consistently controlled from one loading and firing to the next.

This is achieved using controlled air spaces 107 and powder-excluding protrusions 119, such a those illustrated in FIG. 2, rear view, and FIGS. 13-16. These powder-excluding protrusions 119 physically bar unwarranted entry of powder charge 10 into controlled air spaces 107, and controlled air spaces 107 provide a consistently-defined, powder-free air space in which detonation pressure can build up once the powder charge 10 is detonated, resulting in a superior ballistic outcome. When powder charge 10 comprises one or more solid powder pellets (so-called "pelletized powder" commonly employed today), powder-excluding protrusions 119 seat directly in front of powder charge 10 as shown in FIG. 10, such that powder charge 10 is substantially barred from entering into controlled the air spaces 107. In contrast, with a design such as illustrated in U.S. Pat. Nos. 5,458,064 and 5,621,187, the powder charge 10 can set itself right into the air space, which yields a less-desirable result. When powder charge 10 instead comprises older-style fine-granular powder, it is not possible to keep all the powder out of controlled air space 107, but powder-excluding protrusions 119 nevertheless tend to tamp up against powder charge 10, and the air space will still be superior to that which would be created using the commonly-employed designs of U.S. Pat. Nos. 5,458,064 and 5,621,187.

While FIG. 2 illustrates a honeycomb configuration for controlled air spaces 107 and powder-excluding protrusions 119, it is to be understood that this configuration is illustrative, not limiting. Some form of radially-symmetric configuration is of course desirable to ensure proper balanced distribution of firing pressures behind projectile assembly 5. But within this general goal of balancing pressures substantially uniformly behind the projectile assembly many suitable configurations may be conceived of. The broad objective is to create a controlled air space to the rear of the projectile assembly 5 by creating a substantially-balanced array of controlled air spaces 107 alternating with powder-excluding protrusions 119 as shown in FIG. 2.

This is elaborated by considering FIGS. 12 through 16. A lead bullet with no gas check, wrapper, sabot, or pressure shield has no memory after it engraved and loaded into barrel. The result is a loose fit and the bullet can move forward off the powder and create dangerous pressures. Consequently, the prior art has advanced to the point that projectiles generally have a gas check 120 as illustrated in FIG. 12, and the powder charge 10 burns behind an uncontrolled air space 122 bounded by gas check 120. Because there are no powder-excluding protrusions 119 to control this air space, powder charge 10 can infiltrate air space 122 which compromises the quality of the oxidation and, because it is likely that the infiltration will be asymmetric, the ballistic results will be highly variable which is clearly undesirable. This is part of the reason why muzzle-loaded firearms (e.g., shotguns) have a reputation for inconsistent firing. The colloquialism about doing something "with a shotgun" is a derogatory expression implying an aim which is poor and inconsistent and likely to hit targets other than those intended.

This situation is improved to some degree by the configuration of FIG. 13. Here, a concentric series of powder-excluding protrusions 119 create controlled air spaces 107 which avert the aforementioned problems of FIG. 12. However, as noted earlier, there is no structural integrity in the gas check 120 in FIG. 13, which is to say that gas check 120 can readily be deformed by the loading of the projectile into the firearm, by an irregular contact with the powder charge, and by various other vagaries of storage, loading and firing which all have to potential to produce inconsistent ballistic results. Thus, it is important not only to control the air space, but also to avoid deformation of gas check 120. Weak gas checks and sabots with current bullet designs are a major impediment to consistent ballistic accuracy. Something thus needs to be done to strengthen gas check 120, while retaining its flexible character so that it can seat and seal properly against the barrel and prevent leakage of the force from the detonating powder charge 10.

It is this rationale that underlies the use of a honeycomb configuration in FIG. 2 to establish controlled air spaces 107. However, as noted, there are a wide range of possible preferred configurations for powder-excluding protrusions 119 to produce controlled air spaces 107 and to avoid deformation of gas check 120 by adding structural strength and rigidity thereto. FIGS. 14-16 illustrate three such alternatives, with the recognition that many other alternative configuration would also achieve this desired result within the scope of this disclosure and its associated claims. FIG. 14 illustrates a "cross" or "plus" or "x" configuration. FIG. 15 illustrates a radial grid of powder-excluding protrusions 119. FIG. 16 illustrates a network of circular powder-excluding protrusions 119. Not specifically illustrated, but also possible within the scope of this disclosure and its associated claims for powder-excluding protrusions structurally connecting together a plurality of locations on an inner wall 121 of gas check 120, so as the strengthen gas check 120, would be a wide range of grids, lattices, and other configurations that should be readily apparent to someone of ordinary skill based on the teachings herein.

Next we turn to the circumferential belts, such as but not limited to front circumferential belt 110 and a rear circumferential belt 111. Very often, when one attempts to load a non-belted bullet into a muzzle-loading firearm, the lead or similar obturating bullet material comprising the bullet resists the loading into the bore merely by frictional pressure between the bullet and bore. On the one hand, some pressure between the bullet and bore is desirable, so that the rifling of the bore can be etched onto the bullet, but too much pressure impedes loading. So the balance is an important one which is not easily arrived at. A poor concession is to forego the rifling etching by making the bullet with a smaller diameter than the bore.

As noted earlier, circumferential belts 110 and 111 wrap part of the outside body of projectile assembly 5 as illustrated in FIG. 8 and elsewhere. They comprise a different, preferably softer, less-dense belt material than bullet 1. Preferably, they comprise a protective lubricant 8 such as discussed above. The employment of a softer, lubricating material in circumferential belts 110 and 111 and of a bullet assembly 5 "waist" with a diameter slightly reduced relative to the front and rear diameters (FIG. 9 best illustrates the reduced waist), helps arrive at the proper balance to enable good etching without undue loading impedance, as well as lubrication and bore protection. In short, this substantially reduces the projectile assembly surface area to be engraved at loading, minimizes deformation of bullet 1 during loading, minimizes loading impedance, provides proper seating and etching at both the front and the rear of projectile assembly 5, maintain the firearm bore 9 in good condition without fouling, and enables controlled weight reduction (and weight control generally). All of this vastly enhances ballistic integrity over the prior art. In addition, this minimum engraving to projectile assembly 5 allows for increased upsetting of unwanted bore deposits upon ignition, thus providing a self-cleaning action to aid in repeated loading of another shot with little effort and minimal distortion of projectile assembly 5. The employment of a less-dense material such as protective lubricant 8 in circumferential belts 110 and 111, on the other hand, as well as latitude choosing in the depth of these belts, allows the projectile assembly to be made longer for a given weight, and as noted earlier, a longer projectile assembly, particularly while spinning in flight about its axis, will have a greater ballistic stability and thus yield a truer, more accurate flight to target.

As noted earlier, pressure-shield 103 is integrally connected to the rear of the bullet 1, thus comprising a non-discarding design. As opposed to prior art discarding pressure shields, this non-discarding design yields greater ballistic accuracy and consistency.

The diameters of the various projectile assembly 5 subassemblies, as well as those of the various subassemblies and subcomponents themselves, have already been discussed at length, in general terms. We now turn to some specific quantitative examples of how all these measurements relate to one another. In the discussion to follow, we examine 0.45, 0.50, 0.52, 0.54, and 0.58 caliber projectile assemblies, simply to provide examples of suitable measurements and ballistic tolerances arrived at through careful experimental research and testing. This discussion to follow is in no way intended to limit the invention to the specific dimensions and tolerances illustrated, but merely to provide examples which can then be applied by a person of ordinary skill to other projectile assembly dimensions, and even to vary the dimensions of the illustrated 0.45, 0.50, 0.52, 0.54, and 0.58 caliber projectile assemblies, all within the scope of this disclosure and its associated claims. Further, while the specified calibers and related measurements are of course understood in accordance with common practice to be specified in inches, this in no way preclude the application of this disclosure to projectile assemblies which are measured in metrics, or any other system of measurement.

As illustrated in FIG. 5, for a projectile assembly intended for a 0.45 caliber firearm (defined as a firearm with a bore land diameter 154 with dimension 102 of 0.45 inches), bullet diameter 141 is preferably between approximately 0.452 and 0.454 inches. That is, bullet diameter 141 exceeds the caliber by approximately 0.002 to 0.004 inches, or alternatively, by approximately 0.44% to 0.89%. This is because in reality, the Small Arms and Ammunition Institute (SAAMI) suggests and many firearms are indeed produced with a land of about 0.000 to 0.004 inches above the designated caliber. Pressure shield maximum diameter 145 for such a 0.45 caliber projectile assembly 5 is preferably between 0.458 and 0.460 inches. That is, pressure shield maximum diameter 145 exceeds caliber by approximately 0.008 to 0.010 inches, or alternatively, by approximately 1.77% to 2.22%. Pressure shield rear diameter 147 for such a 0.45 caliber projectile assembly 5 is preferably approximately 0.440 inches, and is thus smaller than caliber by approximately 0.01 inches, or alternatively, is smaller by approximately 2.22%. Finally, bullet engraving surface 140 is preferably between approximately 0.456 and 0.457 inches, exceeding caliber by 0.006 to 0.007 inches, or alternatively, by 1.33% to 1.56%.

Please note that earlier, it was stated that pressure shield maximum diameter 145 and bullet engraving surface 140 were each of approximately equal dimension 106, though it was also noted it is desirable to make bullet engraving surface 14 very slightly smaller than pressure shield maximum diameter 145. As can be seen in the detailed dimensions set forth in FIG. 11, it is actually preferred for pressure shield maximum diameter 145 to be very slightly larger than bullet engraving surface 140 by about 0.001 to 0.003 inches, or by about 0.2% to 0.7%, preferably greater than 0.25% and preferably less than 0.5%. This puts slightly more of the pressure for concentrically seating and retaining the projectile assembly 5 in barrel 9 in the pressure shield 103, and slightly less pressure on bullet engraving surface 140. This reduces loading impedance slightly, and reduces back-drag on the front of projectile assembly 5 as it leaves the firearm. In experimental tests, this slight skewing of the bore pressure from the front toward the rear of projectile assembly 5 has proved to yield a superior ballistic result.

For a projectile assembly intended for a 0.50 caliber firearm, bullet diameter 141 is preferably between approximately 0.502 and 0.504 inches. That is, bullet diameter 141 exceeds caliber by approximately 0.002 to 0.004 inches, or alternatively, by approximately 0.4% to 0.8%. Pressure shield maximum diameter 145 for such a 0.50 caliber projectile assembly 5 is preferably between 0.508 and 0.510 inches. That is, pressure shield maximum diameter 145 exceeds caliber by approximately 0.008 to 0.010 inches, or alternatively, by approximately 1.6% to 2.0%. Pressure shield rear diameter 147 for such a 0.50 caliber projectile assembly 1 is preferably approximately 0.490 inches, and is thus smaller than caliber by approximately 0.01 inches, or alternatively, by approximately 2.0%. Finally, bullet engraving surface 140 is preferably between approximately 0.506 and 0.507 inches, exceeding caliber by 0.006 to 0.007 inches, or alternatively, by 1.2% to 1.4%.

For a projectile assembly intended for a 0.52 caliber firearm, bullet diameter 141 is preferably between approximately 0.522 and 0.524 inches. That is, bullet diameter 141 exceeds caliber by approximately 0.001 to 0.002 inches, or alternatively, by approximately 0.38% to 0.77%. Pressure shield maximum diameter 145 for such a 0.52 caliber projectile assembly 5 is preferably between 0.528 and 0.530 inches. That is, pressure shield maximum diameter 145 exceeds caliber by approximately 0.008 to 0.010 inches, or alternatively, by approximately 1.54% to 1.92%. Pressure shield rear diameter 147 for such a 0.52 caliber projectile assembly 1 is preferably approximately 0.510 inches, and is thus smaller than caliber by approximately 0.01 inches, or alternatively, by approximately 1.92%. Finally, bullet engraving surface 140 is preferably between approximately 0.526 and 0.527 inches, exceeding caliber by 0.006 to 0.007 inches, or alternatively, by 1.15% to 1.35%.

For a projectile assembly intended for a 0.54 caliber firearm, bullet diameter 141 is preferably between approximately 0.542 and 0.544 inches. That is, bullet diameter 141 exceeds caliber by approximately 0.001 to 0.002 inches, or alternatively, by approximately 0.37% to 0.74%. Pressure shield maximum diameter 145 for such a 0.54 caliber projectile assembly 5 is preferably between 0.548 and 0.550 inches. That is, pressure shield maximum diameter 145 exceeds caliber by approximately 0.008 to 0.010 inches, or alternatively, by approximately 1.48% to 1.85%. Pressure shield rear diameter 147 for such a 0.54 caliber projectile assembly 1 is preferably approximately 0.530 inches, and is thus smaller than caliber by approximately 0.01 inches, or alternatively, by approximately 1.85%. Finally, bullet engraving surface 140 is preferably between approximately 0.546 and 0.547 inches, exceeding caliber by 0.006 to 0.007 inches, or alternatively, by 1.11% to 1.30%.

For a projectile assembly intended for a 0.58 caliber firearm, bullet diameter 141 is preferably between approximately 0.582 and 0.584 inches. That is, bullet diameter 141 exceeds caliber by approximately 0.001 to 0.002 inches, or alternatively, by approximately 0.34% to 0.69%. Pressure shield maximum diameter 145 for such a 0.58 caliber projectile assembly 5 is preferably between 0.588 and 0.590 inches. That is, pressure shield maximum diameter 145 exceeds caliber by approximately 0.008 to 0.010 inches, or alternatively, by approximately 1.38% to 1.72%. Pressure shield rear diameter 147 for such a 0.58 caliber projectile assembly 1 is preferably approximately 0.570 inches, and is thus smaller than caliber by approximately 0.01 inches, or alternatively, by approximately 1.72%. Finally, bullet engraving surface 140 is preferably between approximately 0.586 and 0.587 inches, exceeding caliber by 0.006 to 0.007 inches, or alternatively, by 1.03% to 1.21%.

In general, the bullet diameter 141 exceeds the caliber by from 0.34% to 0.89%. The pressure shield maximum diameter 145 generally exceeds caliber by 1.38% to 2.22%. A wider pressure shield 103 will of course offer a tighter fit, but may create unwarranted loading impedance if made too large. Finally, while pressure shield rear diameter 147 is preferably 1.72% to 2.22% smaller than caliber, there is really no limit to how much smaller it can be, so long as it is still wide enough to create the controlled air spaces 107 and powder-excluding protrusions 119 discussed earlier, and so long as the structural integrity of gas check 120 is preserved. Thus, pressure shield rear diameter 118 may be as much as 5%, 10%, and even 15% of caliber. Finally, bullet engraving surface 140 exceeds caliber by approximately 1.03% to 1.56%.

At this point, we return to look more closely at some illustrative dimensions for dynamically expanding hollow core 104. As discussed earlier, the core diameter increases progressively from rear to front, from rear core diameter 143 (dimension 113) to front core diameter 142 (dimension 114). For a 0.50 caliber firearm, rear core diameter 113 is about 0.19 inches, while front core diameter 114 is about 0.30 inches, or about 57.9% greater than rear core diameter 113. Front core diameter 114 in turn is about 0.20 inches less than caliber, or about 40% less than caliber. Similar magnitude differences and/or ratios would apply to other calibers. Preferably, general dynamically expanding hollow core 104 is about 60% wider toward front over rear, though can be as little as 35%, 30%, 25%, 20%, 15%, 10% and even 5% wider toward front over rear, and as much as 50%, 60%, 70%, 80% 90% and even 100% wider. As a general rule, any increased diameter ratio, front over rear, will increase expansion, and is yet another of the factors noted above than can be employed to control the rate of expansion on impact.

Thus far, we have reviewed the considerations involved in establishing various key diameters for projectile assembly 5. Now, we turn to examining the various lengthwise dimensions of projectile assembly 5, including its overall length, the length of bullet 1 in relation to the length of pressure shield 103, and the placement, and depth of circumferential belts 110, 111.

In FIG. 1, which is illustrative, not limiting, the overall length of bullet subassembly 1 is approximately one inch. In particular, each of the length segments designated by 161, 163 and 165 is approximately 0.1 inch inches, those segments designated by 162 and 164 are 0.25 inches, and that designated by 160 is approximately 0.2 inches. The depth 166 of circumferential belts 110, 111 is approximately 0.05 inches. However, what is more important than any of these dimensions is that the choice of these dimensions can be varied at will to vary the weight projectile assembly 5 while maintaining a desired predetermined length for projectile assembly 5. For example, not limitation, it may be desired to manufacture a 0.45 caliber, 1 inch long bullet subassembly 1 at weights of 200, 250 and 300 grains. Or to manufacture a 0.50 caliber, 1 inch long bullet subassembly 1 at weights of 250, 300 and 350 grains. Or, to manufacture a 0.54 caliber, 1 inch long bullet subassembly 1 at weights of 300, 350 and 400 grain. More generally, by adjusting the lengths 161, 163, 165 of circumferential belts 110, 111, the number of such belts employed (one, two, three, or more), the depth 166 of each belt, the hardness (density) of protective lubricant 8, and the materials/weights used for pressure shield subassembly 2 and expansion-inducing tip subassembly 3, in varying combinations, it becomes possible to produce varying-weight projectile assemblies 5 of a given predetermined caliber and length. Please note that the use of grains, as opposed to some other weight unit to discuss bullet weight, is not in any way limiting of the disclosure and its associated claims to bullets characterized according to grains rather than some other scale.

We now turn to the front end (nose) of projectile assembly 5 at the front of expansion-inducing tip 105. While this is illustrated to comprise a flat nose, it will be appreciated that the nose geometry may, of course, be varied at will to affect the ballistic properties of projectile assembly 5. Further, the size, shape, and materials employed for expansion-inducing tip 105 has an impact on target penetration versus expansion after striking the target, and as such, these parameters may be varied to produce the desired impact effect. It is to be understood that the illustration of the particular nose configuration and geometry herein does not in any way preclude other nose configurations and geometries within the scope of this disclosure and its associated claims.

As noted earlier, while FIG. 8 in particular illustrates a preferred embodiment of projectile assembly 5, there may be other methods apparent to someone of ordinary skill for arriving at a projectile assembly with essentially the same characteristics as the projectile assembly 5 illustrated and elaborated in detail herein. Such similar or equivalent projectile assemblies—even if they differ in terms of the specifics of their subassemblies and how they are assembled—are still regarded to be within the scope of this disclosure and their associated claims. FIG. 17 illustrates one such example, which is configured differently than the embodiment of FIG. 5, but which retains the essential structural and functional characteristics of projectile assembly 5.

The primary difference is that FIG. 17 omits unfilled chamber cavity 802 discussed earlier, and thus is suited for a projectile assembly 5 with a less sensitive expansion for targets where one wishes to guard against premature expansion and ensure that bullet subassembly 1 has entered the target before expansion. That is, in FIG. 8, the core material 3, 306 substantially fills only part of hollow core 104; and hollow core 104 comprises an unfilled chamber cavity 802 unfilled by core material 3, 306. In FIG. 17, core material 3, 306 substantially fills all of hollow core 104.

Figure 18:
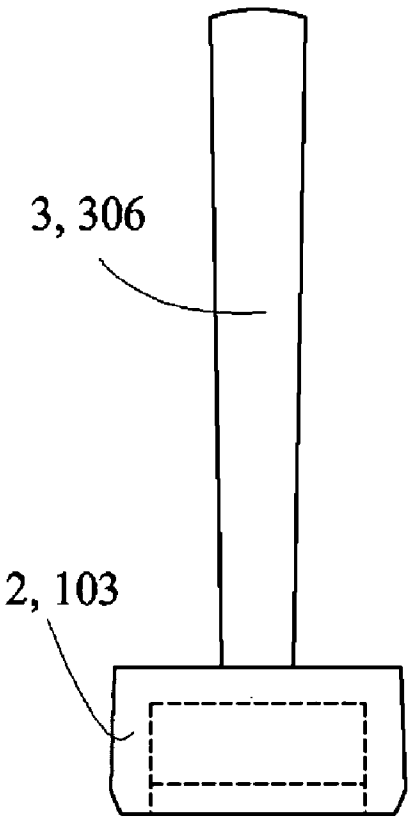
FIG. 18 is a plan view illustrating the pressure shield and a expansion tip of FIG. 17.

FIG. 18 further illustrates the pressure shield and expansion tip of FIG. 17. FIG. 18 is very much like FIG. 7, insofar as each core material 3, 306 substantially fills all of hollow core 104 when each is situated inside of the hollow core 104 of bullet 1. Each—omitting unfilled chamber cavity 802—yields an expansion less sensitive to target impact. However, FIG. 7 illustrates pressure shield subassembly 2 and expansion tip subassembly 3 as separate modules which are respectively inserted into the rear and front of bullet 1 and then mated to yield the total projectile assembly 5 as shown in FIG. 4. FIG. 18, in contract, shows a unitary assembly comprising both pressure shield subassembly 2 and expansion tip subassembly 3. Here, the manufacturing process is different because expansion tip subassembly 3 cannot be inserted through he rear of bullet 1 and pressure shield subassembly 2 cannot be inserted through the front of bullet 1. Thus, this combined assembly of FIG. 18 comprising both pressure shield subassembly 2 and expansion tip subassembly 3 is either fabricated inside hollow core 104 of bullet 1, or else bullet 1 is fabricated around expansion tip subassembly 3 of the combined FIG. 18 assembly.

Figure 19:
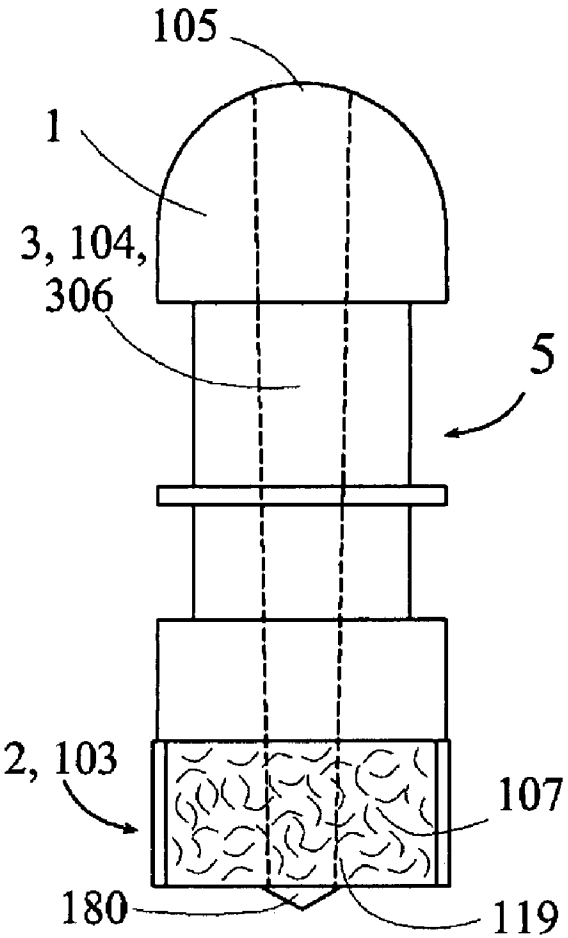
FIG. 19 is a plan view similar to FIG. 17, but illustrating an alternate pressure shield embodiment with controlled air spaces, which may also be discarding.

Finally, we turn to FIG. 19. While it is preferred that pressure shield 103 be non-discarding as discussed earlier, in some instances a discarding pressure shield 103 may be necessary. For example, some states, by law, prohibit the use of sabots or gas checks 120 of a muzzle-loaded projectile. Thus, FIG. 18 comprises a discarding connection 180 connecting pressure shield subassembly 2 with expansion tip subassembly 3. This connection can take many forms, such as but not limited to, snaps, buttons, weak washer connections, etc., and may not necessarily be right at the position designated by 180. The point this that the connection (mating) between pressure shield subassembly 2 with expansion tip subassembly 3 be weak enough such that the gas check 120 will discard while the projectile assembly 5 is in flight. The sole use of the apparatus 103 of FIG. 19 is as a gas seal.

FIG. 19 also illustrates an alternative preferred embodiment for gas check 103. It was earlier noted that is very desirable to provide a controlled air space 107 for proper powder burn, and a number of embodiments were illustrated and discussed for doing so. Another option is to provide a solid, porous material such as but not limited to woven fiber and porous cork. The pores of the porous materials provide controlled air space 107, while solid material serves the same function as powder-excluding protrusions 119 insofar as it excludes powder from entering the controlled air spaces 107 and thus provides the "control" over these air spaces.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

The invention claimed is:

1. A firearm projectile assembly apparatus, comprising:

a bullet;

a hollow core running completely through said bullet from a front of said bullet to a rear of said bullet;

a core material within at least part of said hollow core;

an expansion-inducing tip integral with said core material, and protruding forward of said front of said bullet;

a pressure shield; and a connection between said expansion-inducing tip and said pressure shield through said hollow core, via said core material; wherein:

when said projectile assembly impacts with a target, said expansion-inducing tip drives said core material rearward relative to said hollow core, forcing said bullet to expand radially outwardly; and said connection securely holds said expansion-inducing tip in place during said bullet's flight to a target.

2. The apparatus of claim 1, said hollow core further comprising:

a rear core diameter thereof proximate a rear of said bullet; and a front core diameter thereof proximate a front of said bullet; wherein:

said front core diameter is greater than said rear core diameter.

3. The apparatus of claim 2, said hollow core further comprising:

cross-sectional core diameters thereof increasing progressively from said rear of said bullet to said front of said bullet.

4. The apparatus of claim 3; wherein:

said front core diameter is greater than said rear core diameter by at least fifty percent.

5. The apparatus of claim 2; wherein:

said front core diameter is greater than said rear core diameter by at least fifty percent.

6. The apparatus of claim 1, further comprising:

at least one circumferential belt circumscribing part of said bullet.

7. The apparatus of claim 6, said at least one circumferential belt further comprising:

a protective lubricant.

8. The apparatus of claim 1, further comprising:

a bullet engraving surface thereof toward a front of said bullet; and a primary bullet diameter thereof toward a middle and rear of said bullet; wherein:

a diameter of said bullet engraving surface is greater than said primary bullet diameter.

9. The apparatus of claim 8, wherein:

said diameter of said bullet engraving surface is approximately equal to a diameter of rifling grooves of a firearm barrel in which said bullet is intended to be used; and said primary bullet diameter is approximately equal to a bore land diameter of the firearm barrel in which said bullet is intended to be used.

10. The apparatus of claim 9, said pressure shield further comprising:

a pressure shield front diameter approximately equal to the bore land diameter; and a pressure shield maximum diameter approximately equal to the diameter of the rifling grooves.

11. The apparatus of claim 10, wherein:

said pressure shield maximum diameter exceeds said diameter of said bullet engraving surface by at least 0.2%; and said pressure shield maximum diameter exceeds said diameter of said bullet engraving surface by at most 0.7%.

12. The apparatus of claim 10, said pressure shield further comprising:

a pressure shield rear diameter less than the bore land diameter.

13. The apparatus of claim 1, said pressure shield further comprising:

a pressure shield front diameter approximately equal to a bore land diameter of a firearm barrel in which said bullet is intended to be used; and a pressure shield maximum diameter approximately equal to a diameter of rifling grooves of the firearm barrel.

14. The apparatus of claim 13, said pressure shield further comprising:

a pressure shield rear diameter less than the bore land diameter.

15. The apparatus of claim 1, further comprising:

a non-discarding attachment of said pressure shield to said bullet, such that after said projectile assembly is fired from a firearm, said pressure shield does not discard from said bullet during said bullet's flight to the target.

16. The apparatus of claim 1, said pressure shield further comprising:

a controlled air space comprising:

powder-excluding protrusions; and air recesses amidst said powder-excluding protrusions.

17. The apparatus of claim 16, said powder exclusions comprising a configuration selected from the configuration group consisting of:

a honeycomb; an "x"; circles; lattices; and a grid.

18. The apparatus of claim 16, said pressure shield further comprising:

said powder-excluding protrusions structurally connecting together a plurality of locations on an inner wall of said gas check.

19. The apparatus of claim 1, said pressure shield further comprising:

a porous material;

an air space comprising pores of said porous material; and said porous material substantially excluding powder from said air space.

20. The apparatus of claim 1, further comprising:

said core material substantially filling only part of said hollow core; and said hollow core comprising an unfilled chamber cavity unfilled by said core material.

21. The apparatus of claim 1, further comprising:

said core material substantially filling all of said hollow core.

22. The apparatus of claim 1, said expansion-inducing tip comprising:

a driving wedge proximate a rear of said expansion-inducing tip, for driving into and expanding said hollow, responsive to said expansion-inducing tip striking a target.

23. The apparatus of claim 1, further comprising a pressure shield subassembly comprising:

a pressure shield mating extension inserted into said hollow core proximate said rear of a bullet; and said pressure shield integrally attached proximate a rear of said pressure shield mating extension, said pressure shield comprising a rearward-oriented gas check.

24. The apparatus of claim 23, further comprising:

an expansion tip subassembly comprising:

an expansion tip mating extension comprising said core material, inserted into said hollow core proximate said front of said bullet; and said expansion-inducing tip, integrally attached proximate a front of said expansion tip mating extension; and said pressure shield mating extension mated with said expansion tip mating extension.

25. The apparatus of claim 24, further comprising:

said pressure shield mating extension mated with said expansion tip mating extension such that after said projectile assembly is fired from a firearm, said pressure shield does not discard from said bullet during said bullet's flight to the target.

26. The apparatus of claim 25, said pressure shield comprising:

a porous material;

an air space comprising pores of said porous material; and said porous material substantially excluding powder from said air space.

27. The apparatus of claim 1, further comprising an expansion tip subassembly comprising:

an expansion tip mating extension comprising said core material, inserted into said hollow core proximate said front of said bullet; and said expansion-inducing tip, integrally attached proximate a front of said expansion tip mating extension.

28. The apparatus of claim 1, further comprising:

said core material substantially filling only part of said hollow core; and said hollow core comprising an unfilled chamber cavity unfilled by said core material.

29. The apparatus of claim 1, further comprising:

said expansion tip subassembly substantially filling all of said hollow core.

30. A bullet assembly comprising: a hollow core running completely through a bullet from a front of said bullet to a rear of said bullet; an expansion-inducing tip integral with a core material within at least part of said hollow core, and protruding forward of said front of said bullet; a pressure shield; and a connection between said expansion-inducing tip and said pressure shield through said hollow core, via said core material; wherein: said connection securely holds said expansion-inducing tip to remain in place during said bullet's flight to a target; and said core material is capable, when said bullet assembly impacts with a target, of being driven rearward relative to said hollow core by said expansion-inducing tip, forcing said bullet to expand radially outwardly.

31. The bullet subassembly of claim 30, said hollow core comprising:

a rear core diameter thereof proximate a rear of said bullet subassembly; and a front core diameter thereof proximate a front of said bullet subassembly; wherein:

said front core diameter is greater than said rear core diameter.

32. The bullet subassembly of claim 31, said hollow core further comprising cross-sectional core diameters thereof increasing progressively from said rear of said bullet subassembly to said front of said bullet subassembly.

33. The bullet subassembly of claim 32; wherein:

said front core diameter is greater than said rear core diameter by at least fifty percent.

34. The bullet subassembly of claim 31, wherein:

said front core diameter is greater than said rear core diameter by at least fifty percent.

35. The bullet subassembly of claim 30, further comprising:

a bullet engraving surface thereof toward a front of said bullet subassembly; and a primary bullet diameter thereof toward a middle and rear of said bullet subassembly; wherein:

a diameter of said bullet engraving surface is greater than said primary bullet diameter.

36. The bullet subassembly of claim 35, wherein:

said diameter of said bullet engraving surface is approximately equal to a diameter of rifling grooves of a firearm barrel in which said bullet subassembly is intended to be used; and said primary bullet diameter is approximately equal to a bore land diameter of the firearm barrel in which said bullet subassembly is intended to be used.

37. A firearm projectile assembly apparatus, comprising: a bullet comprising a hollow core running completely through said bullet from a front of said bullet to a rear of said bullet; a pressure shield subassembly comprising an elongated pressure shield mating extension, and a pressure shield integrally attached proximate a rear of said pressure shield mating extension, said pressure shield comprising a rearward-oriented gas check; an expansion tip subassembly comprising an expansion-inducing tip integral with a core material, said core material comprising an expansion tip mating extension and residing within at least part of said hollow core, and said expansion-inducing tip protruding forward of said front of said bullet and integrally attached proximate a front of said expansion tip mating extension; said pressure shield mating extension inserted into the rear of said hollow core; said expansion tip mating extension inserted into the front of said hollow core; and said pressure shield mating extension mated with said expansion tip mating extension.

38. The apparatus of claim 37, further comprising:

said pressure shield mating extension mated with said expansion tip mating extension such that after said projectile assembly is fired from a firearm, said pressure shield does not discard from said bullet during said bullet's flight to a target.

39. The apparatus of claim 37, said hollow core comprising:

a rear core diameter thereof proximate a rear of said bullet subassembly; and a front core diameter thereof proximate a front of said bullet subassembly; wherein:

said front core diameter is greater than said rear core diameter.

40. The apparatus of claim 39, said hollow core further comprising cross-sectional core diameters thereof increasing progressively from said rear of said bullet subassembly to said front of said bullet subassembly.

41. The apparatus of claim 40; wherein:

said front core diameter is greater than said rear core diameter by at least fifty percent.

42. The apparatus of claim 39; wherein:

said front core diameter is greater than said rear core diameter by at least fifty percent.

43. The apparatus of claim 37, further comprising:

at least one circumferential belt circumscribing part of said bullet subassembly.

44. The apparatus of claim 43, said at least one circumferential belt further comprising:

a protective lubricant.

45. The apparatus of claim 37, further comprising: a bullet engraving surface thereof toward a front of said bullet subassembly; and a primary bullet diameter thereof toward a middle and rear of said bullet subassembly; wherein:

a diameter of said bullet engraving surface is greater than said primary bullet diameter.

46. The apparatus of claim 45, wherein:

said diameter of said bullet engraving surface is approximately equal to a diameter of rifling grooves of a firearm barrel in which said bullet subassembly is intended to be used; and said primary bullet diameter is approximately equal to a bore land diameter of the firearm barrel in which said bullet subassembly is intended to be used.

47. The apparatus of claim 46, said pressure shield further comprising:

a pressure shield front diameter approximately equal to a bore land diameter of a firearm barrel in which said bullet subassembly is intended to be used; and a pressure shield maximum diameter approximately equal to a diameter of rifling grooves of the firearm barrel in which said bullet subassembly is intended to be used.

48. The apparatus of claim 47, wherein:

said pressure shield maximum diameter exceeds said diameter of said bullet engraving surface by at least 0.2%; and said pressure shield maximum diameter exceeds said diameter of said bullet engraving surface by at most 0.7%.

49. The apparatus of claim 48, said pressure shield further comprising:

a pressure shield rear diameter less than the bore land diameter.

50. The apparatus of claim 37, said pressure shield further comprising:

a pressure shield front diameter approximately equal to a bore land diameter of a firearm barrel in which said bullet subassembly is intended to be used; and a pressure shield maximum diameter approximately equal to a diameter of rifling grooves of the firearm barrel in which said bullet subassembly is intended to be used.

51. The apparatus of claim 37, said pressure shield further comprising:

a pressure shield rear diameter less than the bore land diameter.

52. The apparatus of claim 37, said pressure shield further comprising:

a controlled air space comprising:

powder-excluding protrusions; and air recesses amidst said powder-excluding protrusions.

53. The apparatus of claim 52, said powder exclusions comprising a configuration selected from the configuration group consisting of:

a honeycomb; an "x"; circles; lattices; and a grid.

54. The apparatus of claim 52, said pressure shield further comprising:

said powder-excluding protrusions structurally connecting together a plurality of locations on an inner wall of said gas check.

55. The apparatus of claim 37, further comprising a pressure shield, said pressure shield further comprising:

a solid, porous material;

an air space comprising pores of said solid, porous material; and the solid nature of said solid, porous material substantially excluding powder from said air space.

56. The apparatus of claim 37, said expansion tip subassembly further comprising:

a driving wedge proximate a rear of said expansion-inducing tip, for driving into and expanding said hollow, responsive to said expansion-inducing tip striking a target.

* * * * *